US009061827B1

(12) United States Patent
Brennan

(10) Patent No.: US 9,061,827 B1
(45) Date of Patent: Jun. 23, 2015

(54) PET WASTE CONTAINER

(71) Applicant: Kathleen Brennan, Laguna Beach, CA (US)

(72) Inventor: Kathleen Brennan, Laguna Beach, CA (US)

( * ) Notice: Subject to any disclaimer, the term of this patent is extended or adjusted under 35 U.S.C. 154(b) by 0 days.

(21) Appl. No.: 14/340,462

(22) Filed: Jul. 24, 2014

(51) Int. Cl.
*B65F 1/10* (2006.01)
*B65F 1/14* (2006.01)

(52) U.S. Cl.
CPC ..... *B65F 1/10* (2013.01); *B65F 1/1426* (2013.01)

(58) Field of Classification Search
CPC ..... A47G 29/22; B65F 1/10; B65F 1/06; B65F 1/0026; B65F 1/1426; B65F 1/16; B65F 1/1607; B65F 1/1646; A47B 88/04; A47B 88/0014; A47B 88/0018; Y10S 220/908; Y10S 220/9081; Y10S 220/9082; Y10S 220/9083
USPC ..... 232/45, 47, 48, 30–32, 43.1, 43.2, 43.3; 220/908, 908.1, 908.2, 908.3, 495.08, 220/495.11; 312/330.1, 211, 212
See application file for complete search history.

(56) References Cited

U.S. PATENT DOCUMENTS

| | | | | | |
|---|---|---|---|---|---|
| 2,690,870 | A * | 10/1954 | Harman | 232/43.2 |
| 3,664,576 | A * | 5/1972 | Potvin | 232/43.2 |
| 4,596,427 | A * | 6/1986 | Pflugfelder | 312/319.1 |
| 4,875,584 | A * | 10/1989 | Ackeret | 206/387.12 |
| 4,955,497 | A * | 9/1990 | Winden et al. | 232/43.2 |
| 5,758,819 | A * | 6/1998 | Sniegocki | 232/4 D |
| 7,252,207 | B2 * | 8/2007 | Liao | 220/495.11 |
| D615,256 | S | 5/2010 | Emerson | |
| 8,336,759 | B2 * | 12/2012 | Skouboe | 232/47 |
| 2012/0031960 | A1 * | 2/2012 | Skouboe | 232/47 |

* cited by examiner

*Primary Examiner* — William Miller
(74) *Attorney, Agent, or Firm* — QuickPatents; Kevin Prince

(57) ABSTRACT

The present invention is a waste container and comprises a hollow base, a drawer assembly, drawer receiver, laterally-slidable drawer, tray, pivot mechanism, and air freshener actuator. The drawer assembly and drawer receiver provide a mechanical means to push in and pull out the laterally-slidable drawer. The laterally-slidable drawer contains the tray responsible unto which waste is deposited. The pivot mechanism positions the tray horizontally and vertically for receiving waste and disposing of it in the base. Because the drawer assembly is separated from the hollow base the user is provided with two separate compartments, one for inserting waste and one for storing it. Also, the nuisance of coming into contact with harmful odors and bacteria in the base is eliminated. Furthermore, the air freshener actuator releases an air freshener into the base to prevent unwanted odors from permeating through the container.

11 Claims, 7 Drawing Sheets

PET WASTE CONTAINER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to waste storage and disposal, and more particularly to a pet waste collection apparatus capable of safely and conveniently disposing of pet waste while eliminating unwanted odors.

DISCUSSION OF RELATED ART

Pet waste can generally be described as excrement left behind by domesticated animals. Pet waste poses a threat to the environment and health when not disposed of properly. Pet waste contains numerous harmful bacteria harmful that also pose a health risk to humans. When disposed of improperly, pet waste may enter the environment through rivers, lakes, streams, water runoff, polluting water and harming fish and other aquatic life.

Most municipalities require proper clean up and disposal of pet waste throughout their communities. Oftentimes, they will provide cleaning stations and disposal stations to properly care for the pet waste. These waste stations provide a great way for responsible pet owners to take care of their environment and an easy way for cities to properly dispose of pet waste. However, pet owners must find other ways to properly dispose of their pet's waste while at home.

Current pet waste disposal systems are adapted to receive and dispose of pet waste in bins. While these pet waste containers are useful in providing a place used solely for disposing of pet waste, they do not contain separate compartments for inserting pet waste and for storing pet waste. Because of this, the bacteria and unwanted odors that fester in the waste bin are exposed to users every time they dispose of pet waste. Furthermore, traditional pet waste containers have no method for preventing unwanted odors from permeating through the container, causing another nuisance for users.

Therefore, there is a need for a device adapted to receive and dispose of pet waste in separate compartments. Furthermore, there is continued need for such a device which is adapted to prevent unwanted odors from permeating through the container. The present invention accomplishes these objectives.

SUMMARY OF THE INVENTION

The present invention is a device that receives and disposes of pet waste in separate compartments and prevents unwanted odors from permeating through the container. This is accomplished by utilizing a hollow base, drawer assembly, drawer receiver, tray, and air freshener actuator. The hollow base provides a receptacle to store articles of pet waste. The drawer assembly and drawer receiver provide a mechanical apparatus to pull out and push in the laterally-slidable drawer. The laterally-slidable drawer houses the tray responsible for depositing pet waste on. The pivot mechanism positions the tray horizontally or vertically depending on whether the drawer is pushed into the receiver or pulled away from the receiver. The tray is positioned inside the drawer receiver and provides a place to deposit articles of pet waste. The air freshener actuator provides a means for eliminating unwanted odors accompanying articles of pet waste.

When the drawer is pulled out from the receiver, the pivot mechanism places the tray in a horizontal orientation to provide a flat surface onto which an article of pet waste may be deposited. When the drawer is pushed into the receiver, the pivot mechanism places the tray in a vertical orientation such that the article of pet waste on the tray is deposited into the hollow base. The method of receiving and transporting articles of pet waste from the drawer to the base provides the user with two separate compartments, one for receiving the waste, and one for storing the waste. This prevents the user from coming into direct contact with festering bacteria and odors that accompany the storage and disposal of pet waste.

The present invention is adapted to receive and dispose of pet waste in separate compartments. Furthermore, provides a means for preventing unwanted odors from permeating through the container. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein,"

"above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
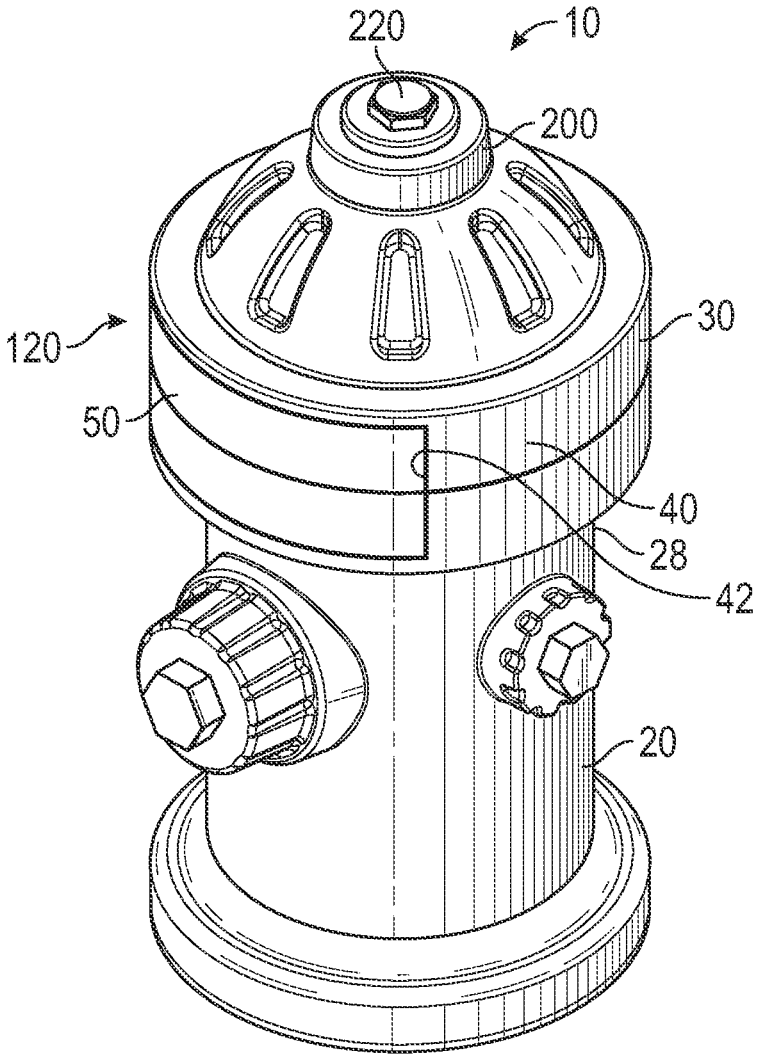
FIG. 1 is a perspective view of the present invention, illustrated with a drawer thereof in a closed position.

The present invention 10 comprises a hollow base 20, drawer assembly 30, drawer receiver 40, laterally-slidable drawer 50, tray 70, pivot mechanism 80, and air freshener actuator 220 (FIG. 1). The hollow base 20 provides a receptacle to store articles of disposed waste 15, such as pet waste. The drawer assembly 30 and drawer receiver 40 provide a mechanical apparatus to pull out and push in the laterally-slidable drawer 50. The laterally-slidable drawer 50 houses the tray 70 upon which the waste 15 is deposited. The pivot mechanism 80 is adapted to position the tray 70 in a horizontal orientation 90 when the drawer 50 is pulled away from the receiver 40, and in a vertical orientation 100 when pushed into the receiver 40. This allows an article of waste 15 deposited on the tray 70 to be released into the hollow base 20 and disposable bag 16. The air freshener actuator 220 provides a means for eliminating unwanted odors accompanying articles of waste 15.

Figure 6:
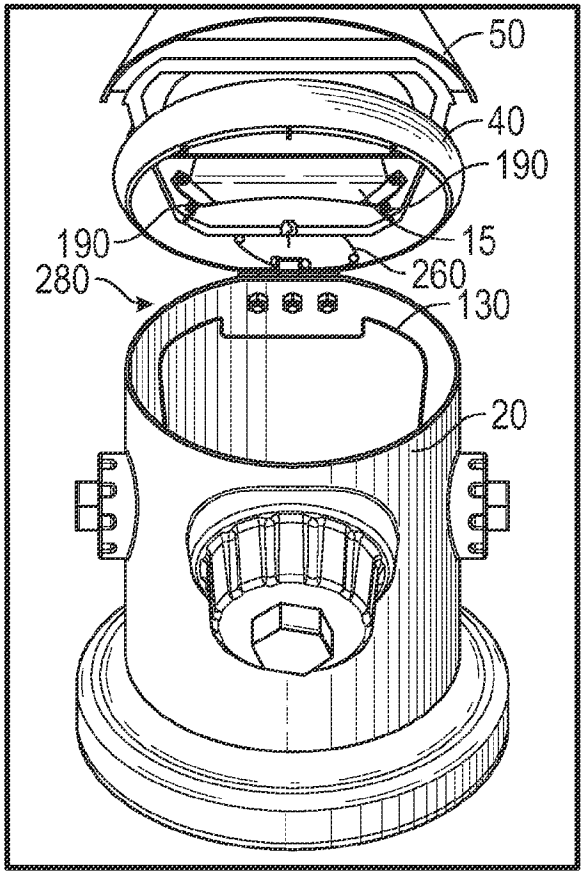
FIG. 6 is a front perspective view of FIG. 4.
Figure 5:
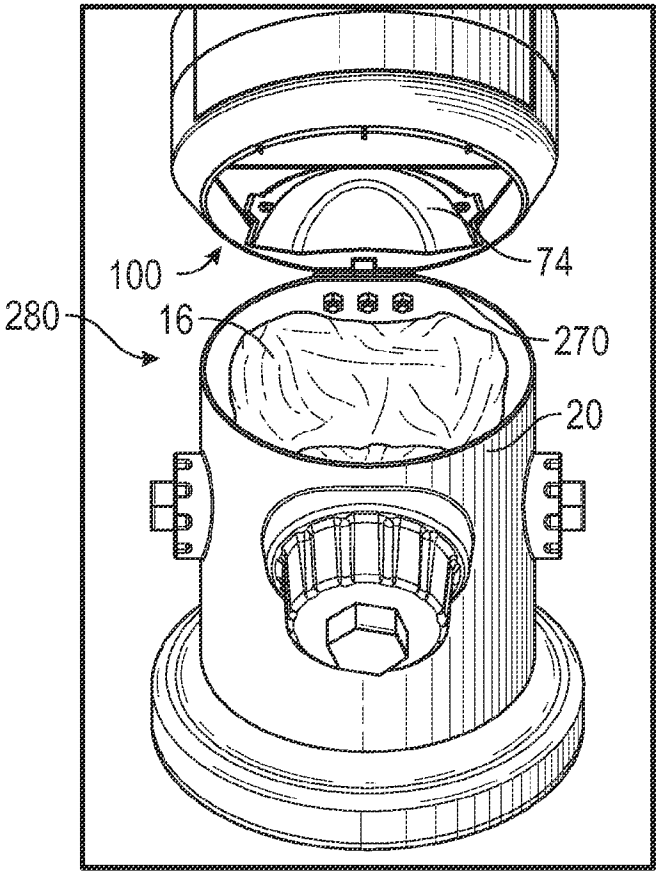
FIG. 5 is a front perspective view of FIG. 4 and further including a disposable bag attached.

The hollow base 20 functions as a receptacle for storing and disposing of articles of waste 15 and comprises an open top end 28 and resilient bag frame 130 (FIG. 6). The resilient bag frame 130 is fixedly attached within the inner top perimeter of the hollow base 20. A disposable bag 16 may temporarily be attached around the resilient bag frame 130. The disposable bag 16 hangs from the top of the resilient bag frame 130 down to the bottom of the hollow base 20 to collect articles of waste 15. In the preferred embodiment, the hollow base 20 is circular in shape and elongated, measuring between 20 and 40 inches in circumference and between 8 to 24 inches in height. The hollow base 20 and resilient bag frame 130 may be constructed from plastic, metal, fiberglass, or any other resilient material.

Figure 2:
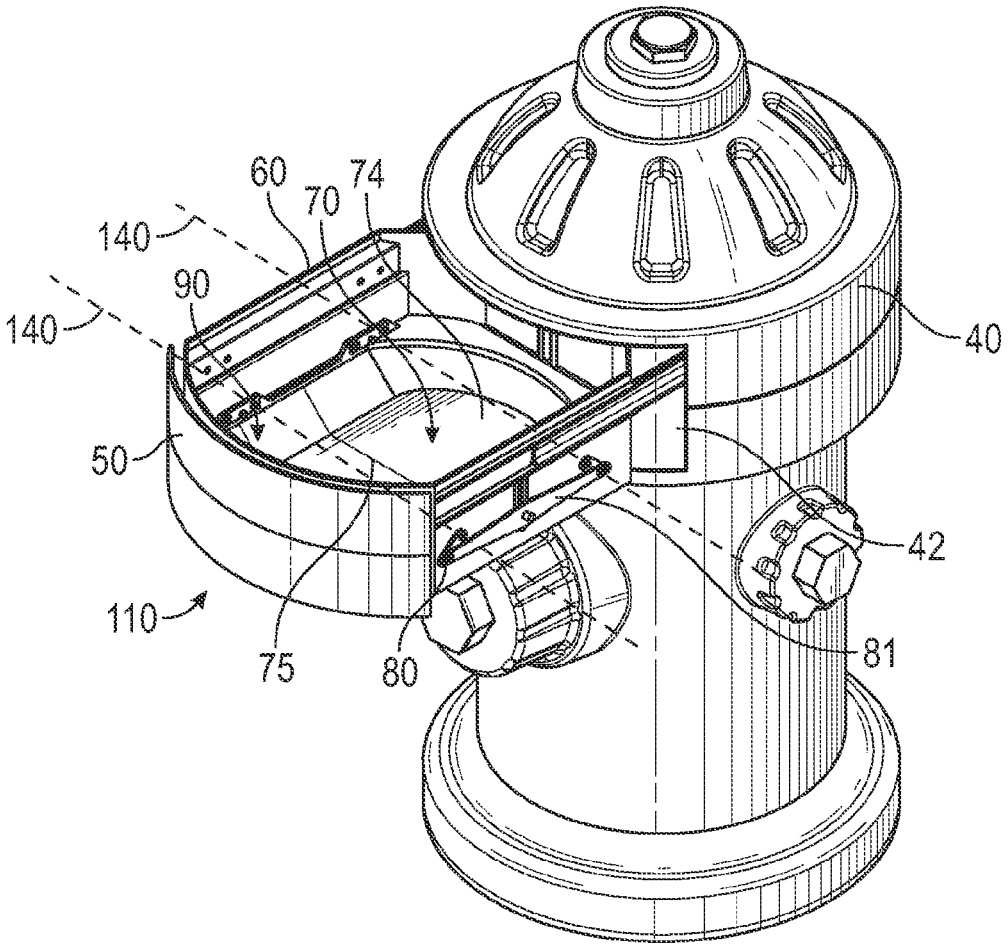
FIG. 2 is a perspective view thereof with the drawer in an open position.
Figure 3:
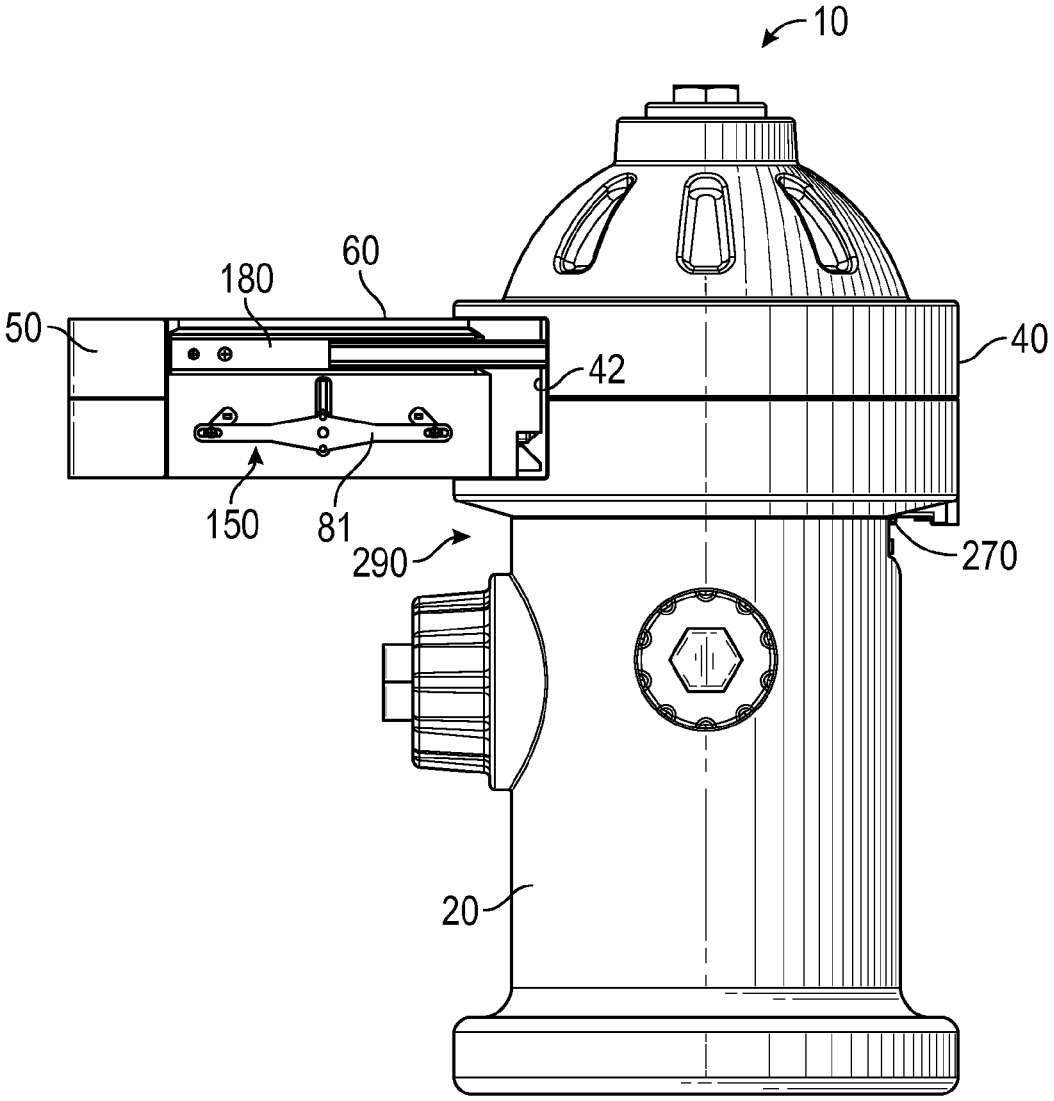
FIG. 3 is a right-side elevational view of the present invention.
Figure 4:
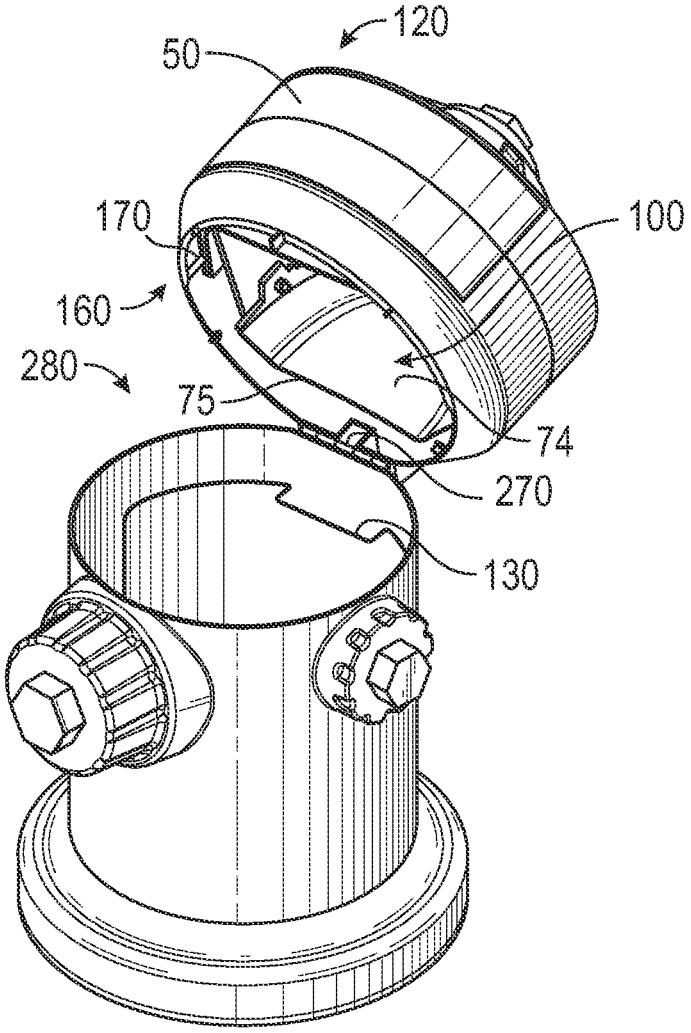
FIG. 4 is a perspective view of the present invention with a drawer assembly in a raised position.

The drawer assembly 30 is fixedly attached to the open top end 28 of the base 20 by a hinge 270 and comprises a drawer receiver 40 and a laterally-slidable drawer 50 (FIG. 2). The drawer receiver 40 further comprises an open side 42 for receiving the laterally-slidable drawer 50 (FIG. 2). The laterally-slidable drawer 50 comprises a frame 60 and a tray 70. The frame 60 provides support for the tray 70 and drawer assembly 30. The tray 70 is pivotally attached to the frame 60 with a pivot mechanism 80 which maintains the tray 70 in a horizontal orientation 90 when the drawer 50 is pulled away from the drawer receiver 40 in an open position 110. The pivot mechanism 80 maintains the tray 70 in a vertical orientation 100 when the drawer 50 is pushed into the receiver 40 in a closed position 120. The drawer assembly 30, drawer receiver 40, laterally-slidable drawer 50, tray 70, and pivot mechanism 80 may be constructed from plastic, metal, fiberglass, or any other rigid material.

The drawer assembly 30 further comprises a pair of drawer sliding mechanisms 180 and a plurality of first biasing mechanisms 190 (FIG. 6). The pair of drawer sliding mechanisms 180 is fixedly attached to either side of the drawer 50 between the drawer 50 and the receiver 40, whereby the drawer 50 may be removed from the receiver 40 to facilitate cleaning thereof. The plurality of first biasing mechanisms 190 is fixed between each half of the tray 74 and the drawer frame 60 and urges each tray 74 into the horizontal orientation 90. The pair of drawer sliding mechanisms 180 and plurality of first biasing mechanisms 190 may be constructed from plastic, metal, fiberglass, or any other suitable rigid material.

The tray 70 is split down a centerline 75 thereof such that the pivot mechanism 80 acts to counter-rotate each half 74 of the tray 70 90-degrees upon moving the drawer 50 from the open position 110 to the closed position 120 (FIG. 2). The pivot mechanism 80 further comprises at least one pivot bar 81 which is fixedly attached to the drawer frame 60 with an axis 140 of each half 74 of each tray 70. The at least one pivot bar 81 is movable between a lowered position 150 that corresponds to the tray 70 being in the horizontal orientation 90 and a raised position 160 that corresponds to each tray half 74 being in the vertical orientation 100. The at least one pivot bar 81 is moved to the raised position 160 as the drawer 50 is moved to the closed position 120 by a pivot bar post 170 fixed within the receiver 40.

When in use, the pivot mechanism 80 will keep the tray 70 in the horizontal position 90 when the drawer 50 is pulled away from the drawer receiver 40 in the open position 110. In this open position 110, the tray 70 is kept in the horizontal position 90 in order to receive an article of waste 15. When the drawer 50 is pushed back into the drawer receiver 40, the pivot mechanism 80 causes the tray to pivot into the vertical position 100 such that the article of waste 15 falls off the tray 70 and is deposited into the disposable bag 16 positioned around the bag frame 130 within the hollow base 20.

Figure 7:
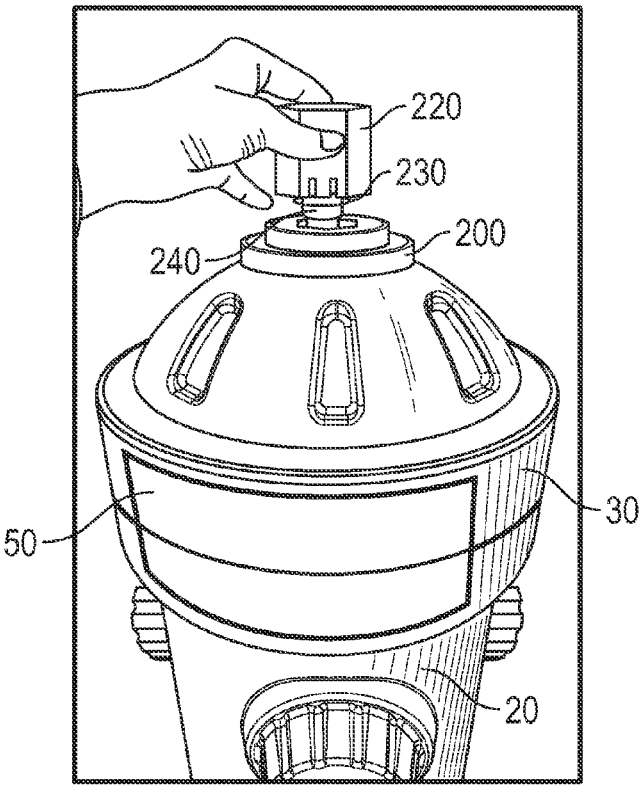
FIG. 7 is a partial front perspective view of the present invention with an air freshener actuator partially removed.
Figure 8:
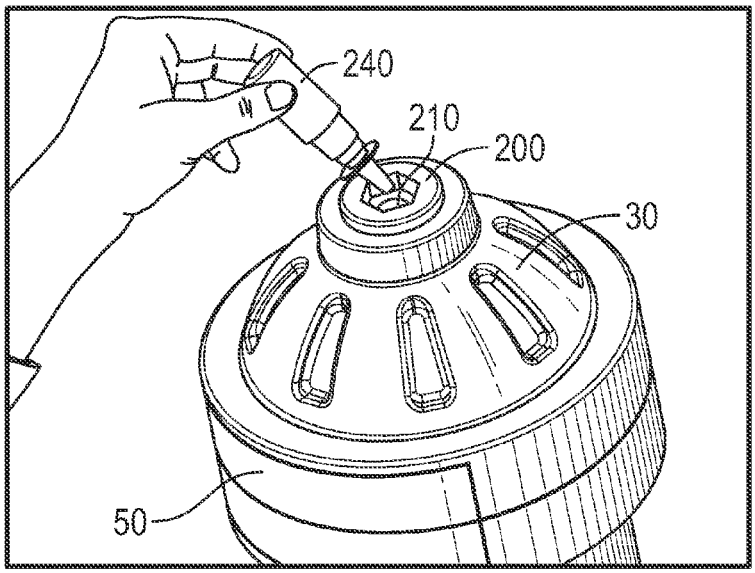
FIG. 8 is a top perspective view of a top portion of the drawer assembly with an air freshener container.

The top portion 200 of the drawer assembly 30 is fixedly attached to the hollow base 20 with a hinge 270 and comprises an open air freshener aperture 210 into which an air freshener actuator 220 may be fixed (FIG. 7). The air freshener actuator 220 contains a pressurized air freshener container 240 positioned inside. A spring 230 keeps the air freshener actuator 220 biased upwardly, whereby upon downward pressing of the air freshener actuator 220 the air freshener container 240 is urged to release an air freshener into the container, past the drawer 50 and into the base 20.

Figure 9:
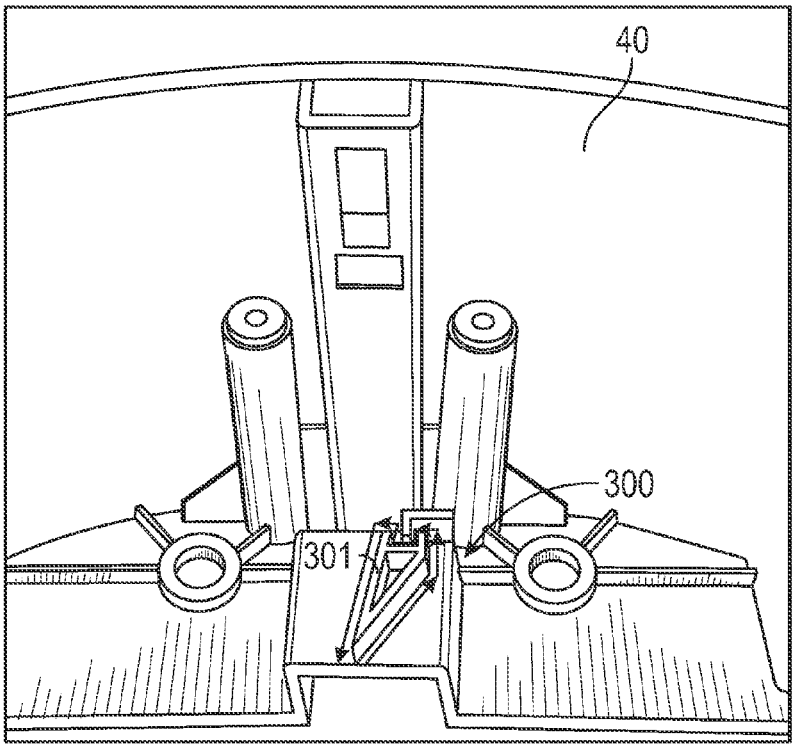
FIG. 9 is a top perspective view of a portion of a drawer receiver, showing a triangular catch of a latch arrangement of the drawer.
Figure 10:
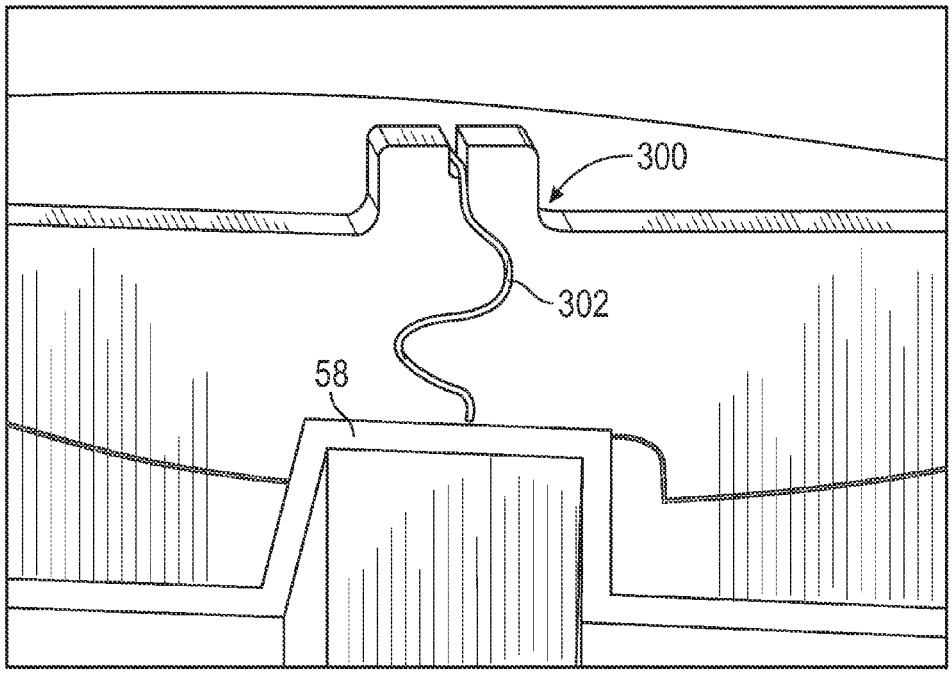
FIG. 10 is a bottom perspective view of a latch pin of the latch arrangement.

A third spring 260 (FIG. 6) is fixed between an end 58 of the drawer 50 and the receiver, the third spring 260 biasing the drawer into the open position 110. A latch arrangement 300 and the third spring 260 are fixed between an end 58 of the drawer 50 and the receiver 40 (FIGS. 9 and 10). This configuration allows the drawer 50 to be pushed in slightly and released. The third spring 260 pushes the drawer 50 into the open position 110, and once the drawer 50 is open 110, the latch arrangement 300 resets so that upon pushing the drawer 50 back fully into the receiver 40 the latch assembly 300 retains the drawer 50 in the closed position 120. The latch arrangement includes a generally triangular catch 301 (FIG. 9) and a latch spring 302 (FIG. 10) fixed with the underside of the drawer 50.

When in use, the user first opens the drawer 50 by pushing in on the receiver 40, releasing the drawer 50 into the open position 110 and revealing the tray 70. The user then places an article of waste 15 onto the tray 70. Once the article of waste 15 has been placed on the tray 70, the user then closes the drawer 50 by pushing in on the drawer 50, sliding the drawer 50 back into the receiver 40. Upon sliding the drawer 50 back into the receiver 40, the pivot bar post 170 contacts the pivot bar to force it into the raised position 160, pivoting each half of each tray 74 into the vertical orientation 100 such that the article of waste 15 falls into the disposable bag 16 housed within the base 20. Further, the latch arrangement 300 retains the drawer 50 in the closed position 120 against the third spring 260 until the drawer 50 is then pushed in again to release the latch arrangement 300, allowing the third spring 260 to urge the drawer 50 back into the open position 110.

The air freshener container 240 is positioned within the of the air freshener actuator 220. When in use, the air freshener actuator 220 is placed in the open air freshener aperture 210. The pressure from the spring 230 keeps the air fresher actuator 220 raised. When the air freshener actuator 220 is pressed downwardly, air freshener spray is released down into the hollow base 20, reducing unpleasant odors within.

When the disposable bag 16 is full of articles of waste 15, the present invention 10 enables the easy removal of the waste 15 and replacement of the bag 16. First, the drawer assembly 30 is placed in the raised position 280, providing access to the base 20. Then, the disposable bag 16 may be removed from the frame 130 and a new bag 16 may be installed. The drawer assembly 30 must then be placed in the closed position 120 before further use.

While a particular form of the invention has been illustrated and described, it will be apparent that various modifications can be made without departing from the spirit and scope of the invention. For example, materials, shapes, and sizes have been designated, although any suitable material, shape, and size may be used. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A waste container comprising:

a hollow base having an open top end;

a drawer assembly fixed with the open top end of the base and including a drawer receiver having an open side receiving a laterally-slidable drawer that includes a frame and a tray, the tray being pivotally fixed within the frame with a pivot mechanism that maintains the tray in a horizontal orientation when the drawer is pulled away from the receiver in an open position and in a vertical orientation when the drawer is pushed into the receiver in a closed position, the tray being split down a centerline thereof, the pivot mechanism acting to counter-rotate each half of the tray 90-degrees upon moving the drawer from the open to the closed position, the pivot mechanism including at least one pivot bar fixed with an axis of each half of each tray, the at least one pivot bar movable between a lowered position that corresponds to the tray being in the horizontal orientation and a raised position that corresponds to each tray half being in the vertical orientation, the at least one pivot bar being moved to the raised position as the drawer is moved to the closed position by a pivot bar post fixed within the receiver;

whereby the drawer is pulled out of the receiver to present the tray in the horizontal orientation, upon which an article of waste is placed, the drawer when pushed into the receiver causing the pivot mechanism to pivot the tray into the vertical orientation to deposit the waste into the base.

2. The waste container of claim 1 wherein the hollow base further includes a resilient bag frame that fits within the base and around which a disposable bag is temporarily attached.

3. The waste container of claim 1 further including a pair of drawer sliding mechanisms fixed to either side of the drawer between the drawer and the receiver, whereby the drawer is removed from the receiver to facilitate cleaning thereof.

4. The waste container of claim 1 further including a plurality of first biasing mechanisms fixed between each half of the tray and the drawer frame and that urges each tray into the horizontal orientation.

5. The waste container of claim 1 wherein a latch arrangement and a spring fixed between an end of the drawer and the receiver allows the drawer to be pushed in slightly and released, the spring pushing the drawer into the open position, and once the drawer is open the latch arrangement resetting so that upon pushing the drawer back fully into the receiver the latch assembly again retains the drawer in the closed position.

6. A waste container comprising:

a hollow base having an open top end;

a drawer assembly fixed with the open top end of the base and including a drawer receiver having an open side receiving a laterally-slidable drawer that includes a frame and a tray, the tray being pivotally fixed within the frame with a pivot mechanism that maintains the tray in a horizontal orientation when the drawer is pulled away from the receiver in an open position and in a vertical orientation when the drawer is pushed into the receiver in a closed position, a top portion of the drawer assembly including an open air freshener aperture, into which an air freshener actuator is fixed that contains a pressurized air freshener container, a spring keeping the air freshener actuator biased upwardly;

whereby the drawer is pulled out of the receiver to present the tray in the horizontal orientation, upon which an article of waste is placed, the drawer when pushed into the receiver causing the pivot mechanism to pivot the tray into the vertical orientation to deposit the waste into the base, and whereby upon downward pressing of the air freshener actuator the air freshener container is urged to release an air freshener into the container, past the drawer and into the base.

7. The waste container of claim 6 wherein the hollow base further includes a resilient bag frame that fits within the base and around which a disposable bag is temporarily attached.

8. The waste container of claim 6 wherein a latch arrangement and a spring fixed between an end of the drawer and the receiver allows the drawer to be pushed in slightly and released, the spring pushing the drawer into the open position, and once the drawer is open the latch arrangement resetting so that upon pushing the drawer back fully into the receiver the latch assembly again retains the drawer in the closed position.

9. A waste container comprising:

a hollow base having an open top end;

a drawer assembly fixed with the open top end of the base and including a drawer receiver having an open side receiving a laterally-slidable drawer that includes a frame and a tray, the tray being pivotally fixed within the frame with a pivot mechanism that maintains the tray in a horizontal orientation when the drawer is pulled away from the receiver in an open position and in a vertical orientation when the drawer is pushed into the receiver in a closed position, the drawer assembly is pivotally attached with the base;

whereby the drawer is pulled out of the receiver to present the tray in the horizontal orientation, upon which an article of waste is placed, the drawer when pushed into the receiver causing the pivot mechanism to pivot the tray into the vertical orientation to deposit the waste into the base, and whereby the drawer assembly is placed between a raised position to access the base and a closed position during normal use.

10. The waste container of claim 9 wherein the hollow base further includes a resilient bag frame that fits within the base and around which a disposable bag is temporarily attached.

11. The waste container of claim 9 wherein a latch arrangement and a spring fixed between an end of the drawer and the receiver allows the drawer to be pushed in slightly and released, the spring pushing the drawer into the open position, and once the drawer is open the latch arrangement resetting so that upon pushing the drawer back fully into the receiver the latch assembly again retains the drawer in the closed position.

* * * * *